US007779524B2

(12) United States Patent
Campian

(10) Patent No.: US 7,779,524 B2
(45) Date of Patent: Aug. 24, 2010

(54) SHORT-FLANGED SHEET MATERIAL FORMING AND JOINING

(75) Inventor: Jonathon Reo Campian, Troy, MI (US)

(73) Assignee: Modern Body Engineering Corporation, Madison Heights, MI (US)

( * ) Notice: Subject to any disclaimer, the term of this patent is extended or adjusted under 35 U.S.C. 154(b) by 1273 days.

(21) Appl. No.: 10/521,654

(22) PCT Filed: Dec. 2, 2004

(86) PCT No.: PCT/US2004/040319

§ 371 (c)(1),
(2), (4) Date: Jan. 14, 2005

(87) PCT Pub. No.: WO2005/056444

PCT Pub. Date: Jun. 23, 2005

(65) Prior Publication Data

US 2006/0117828 A1 Jun. 8, 2006

Related U.S. Application Data

(60) Provisional application No. 60/526,559, filed on Dec. 3, 2003.

(51) Int. Cl.
*B23P 11/00* (2006.01)

(52) U.S. Cl. ..... 29/243.58; 29/243.5; 29/509; 29/243.57; 72/293; 72/297

(58) Field of Classification Search ..... 29/243.58, 29/281.1, 283.5, 243.5, 243.57, 700, 509, 29/464; 72/293, 297

See application file for complete search history.

(56) References Cited

U.S. PATENT DOCUMENTS

| | | | | |
|---|---|---|---|---|
| 4,565,081 | A | 1/1986 | Massee | |
| 5,228,190 | A | 7/1993 | Sawa | |
| 5,237,734 | A | 8/1993 | Polon | |
| 5,454,261 | A * | 10/1995 | Campian | 72/384 |
| 5,457,981 | A * | 10/1995 | Brown et al. | 72/451 |
| 6,089,074 | A * | 7/2000 | Dorsett | 72/450 |
| 6,295,858 | B1 * | 10/2001 | Torito | 72/315 |
| 6,324,880 | B1 * | 12/2001 | Nakamura | 72/17.3 |
| 6,421,893 | B1 * | 7/2002 | Katayama et al. | 29/33 K |
| 6,477,881 | B2 * | 11/2002 | Eloriaga et al. | 72/323 |
| 6,694,793 | B1 | 2/2004 | Persson | |
| 6,742,372 | B2 * | 6/2004 | Baulier | 72/322 |

(Continued)

FOREIGN PATENT DOCUMENTS

DE 100 16 391 A1 10/2001

*Primary Examiner*—Essama Omgba
(74) *Attorney, Agent, or Firm*—Harness, Dickey & Pierce, P.L.C.

(57) ABSTRACT

An apparatus and method is described to form and join a short flange on a periphery of a sheet material supported in a nest (30). The apparatus includes a positional pressure forming steel (PPFS) assembly (50) located on the end of a robotic arm (42). The PPFS assembly (50) includes a hub (52) slidably supported in a cylinder (56). At least one tool steel (70, 70', 70") is located on an extension (68, 68') from the hub (52). A biasing element (58) interposed between the cylinder (56) and the hub (52) enables precise control of the forming pressure by defining a tool path control program which maintains a relative relationship between the PPFS assembly (50) and the nest (30).

30 Claims, 3 Drawing Sheets

U.S. PATENT DOCUMENTS 6,745,608 B2 * 6/2004 Miura ..... 72/306
7,254,973 B2 * 8/2007 Campian ..... 72/220
2005/0217339 A1 10/2005 Toeniskoetter
2008/0250835 A1 * 10/2008 Hasegawa et al. ..... 72/220
2009/0038361 A1 * 2/2009 Toeniskoetter ..... 72/214

* cited by examiner

SHORT-FLANGED SHEET MATERIAL FORMING AND JOINING

CROSS-REFERENCE TO RELATED APPLICATIONS

This application claims the benefit of U.S. Provisional Application No. 60/526,559, filed Dec. 3, 2003. The disclosure of the above application is incorporated herein by reference.

FIELD OF THE INVENTION

The present invention relates to systems that form and join sheet material. More particularly, the present invention describes a tool and method of use in forming and joining the short flanges of a first sheet material to a second sheet material.

DESCRIPTION OF THE RELEVANT ART

One of the earliest operations required in the history of automobile assembly was the joining of an inner panel to an outer panel to form any of a variety of body parts, including doors, engine hoods, fuel tank doors and trunk lids, all referred to as "swing panels" which encase the vehicle frame. Known machines for the forming and joining of sheet materials include the press-and-die set, the tabletop and the roller-forming tool, the latter being the most-recently introduced device.

An unfortunate feature of joining sheet materials is the difficulty of forming short flanges where required by the design. A certain approach has been undertaken to overcome this problem.

One known effort to form short flanges is to use a roller tool and perform multiple rolling passes or nudges to push the flange over from a generally upright configuration to a folded configuration or seam. Though it is an inexpensive approach, repeated roller passes requires an excessive amount of time to perform and does not always form shorter flanges in a satisfactory manner.

Another known effort to form short flanges is to use mechanically pushed forming steel known in the art as a corner unit. This unit mounts on a linear slide normal to the direction the flange is to be form. The corner unit which carries the forming steel is extended by pneumatics or by cam action in a direction normal into the flange to form the flange. The corner unit then retracts to a non-contact position. While this style of forming is fast, the unit gets in the way during other necessary operations, thereby restricting movement of the roller tool. Moreover, the slide must be oriented generally perpendicular to the direction of the seam. It is also relatively expensive to operate and maintain in that it requires independent mechanisms and energy sources for each corner unit.

Accordingly, prior approaches to address short flanged sheet material forming and joining have failed to overcome all the aforementioned problems.

SUMMARY OF THE PRESENT INVENTION

It is thus a general object of the present invention to provide an apparatus and method that overcomes the problems of known techniques for forming and joining the short flanges of a first sheet material to a second sheet material to form a swing panel for an automobile.

It is a particular object of the present invention to provide propelled tooling to form and join a first sheet material to a second sheet material.

Another object of the present invention is to provide such propelled tooling that is flexible enough to accommodate panels of various sizes, shapes, and contours.

A further object of the present invention is to provide such propelled tooling that may be used in conjunction with a robotic arm in operation with a variety of machine cells.

Yet another object of the present invention is to provide a method of forming and joining a pair of sheet materials with a short flange seam.

In accordance with the present invention an apparatus to form and join sheet materials with a short flange includes a positional pressure forming steel (PPFS) assembly is operatively associated with a programmable positioning apparatus in the form of a robotic arm and a machine cell which includes a holder for a first panel in the form of a lower nest, and a holder for a second panel in the form of an upper gate. The PPFS assembly includes a cylinder head with a captured reciprocating piston. A biasing element in the form of a compression spring operably disposed within the cylinder and atop the piston. The biasing element urges the piston to an extended position. A shaft extends through an end of the piston opposite the cylinder and supports a roller. At least one forming steel is located on an extension of the piston between the roller and the cylinder. The forming steel is oriented generally perpendicular to the axis of the shaft.

In accordance with the present invention a method of forming and joining sheet materials with a short flange includes holding a first sheet material in a nest such that a periphery of the first sheet material is supported on a material contacting portion of the nest. A robotic arm locates a positional pressure forming steel relative to the nest and adjacent a short flange on the first sheet material. The robotic arm is manipulated to move the positional pressure forming steel along a tool path such the forming steel forms the short flange over a periphery of said first sheet material. The method may further be employed to join a second sheet material to the first sheet material.

These and other objectives are accomplished by the provision of an apparatus and method for the forming and joining of sheet material as set forth hereinafter.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will be more fully understood by reference to the following detailed description of the preferred embodiments when read in conjunction with the accompanying drawings, in which like reference characters refer to like parts throughout the views, and in which.

DETAILED DESCRIPTION OF THE PREFERRED EMBODIMENTS

The drawings disclose the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

Figure 1:
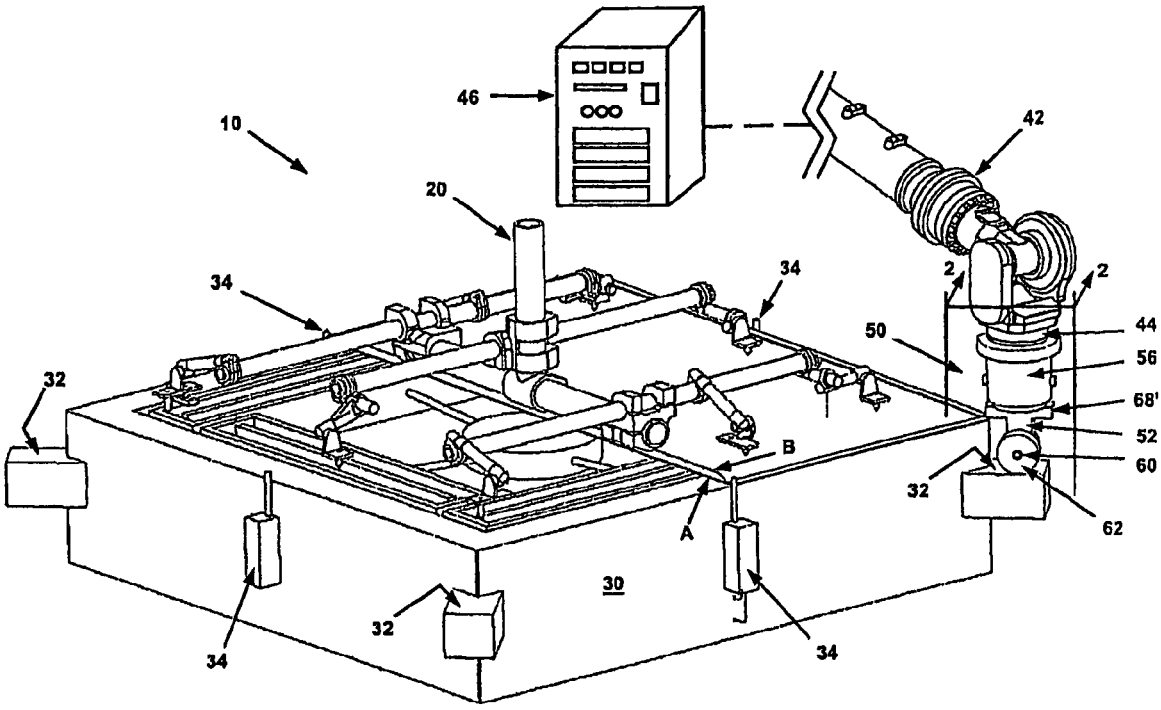
FIG. 1 is a perspective view of a machine cell incorporating a positional pressure forming steel (PPFS) assembly according to the preferred embodiment of the present invention.

With reference first to FIG. 1, the preferred embodiment of a machine cell 10 is illustrated in a perspective view. The machine cell 10 includes an upper gate 20 and a lower nest 30 for precisely locating a sheet material A. The first sheet material A may be precision positioned by means of an array of crowders 34. The machine cell 10 holds sheet material A so that a forming process may be undertaken without the sheet material being caused to shift or otherwise move out of position. As illustrated, first sheet material A has a generally square configuration. In some instances, two sheet materials may be included for purposes of forming and joining the two sheets, in a combination resulting from seaming, to form an integrated component. Accordingly, and as illustrated, an optional second sheet material B may be placed on top of the first sheet material A and aligned with the upper gate 20. Thus, it is to be understood that the shape and number of sheet material being formed may vary without departing for scope of the present invention. It should also be understood that the configuration of the machine cell 10 as illustrated is preferred, but is not to be interpreted as limiting as other configurations conceivable to those skilled in the art may also be suitable. However, a presently preferred nest and gate configuration is disclosed in PCT/US04/34238, which is expressly incorporated by reference herein.

A positional pressure forming steel (PPFS) assembly 50 is operatively associated with a robotic arm 42. The PPFS assembly 50 rigidly mounts to a robotic arm faceplate 44 that is rotatably connected to the robotic arm 42. The robotic arm 42 is itself operatively associated with a computer 46 which executes a run-time program for moving the PPFS assembly 50 along a pre-defined tool path. The PPFS assembly 50 may be selectably rotated to perform a desired operation with a given forming steel. The PPFS assembly 50 includes forming steels 70, 70', 70" as dictated by the particular forming and joining operation to be performed.

Figure 2:
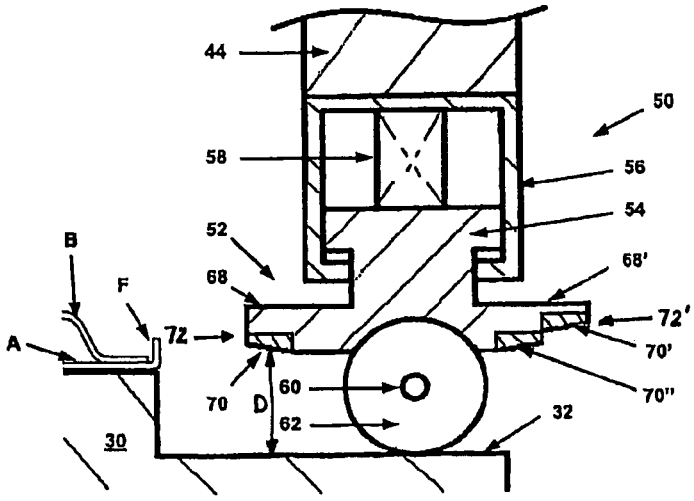
FIG. 2 is a sectional view of the PPFS assembly of the present invention taken along lines 2-2 of FIG. 1 and viewed from the side of the main roller illustrating a first forming steel in its pounce position.
Figure 3:
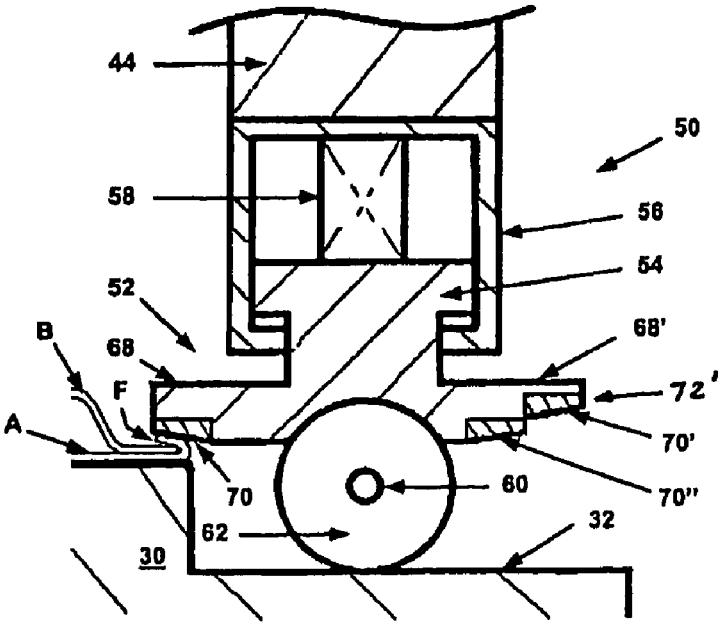
FIG. 3 is a sectional view of the PPFS assembly of the present invention similar to that of FIG. 2 but illustrating the first forming steel in its engaged position.
Figure 4:
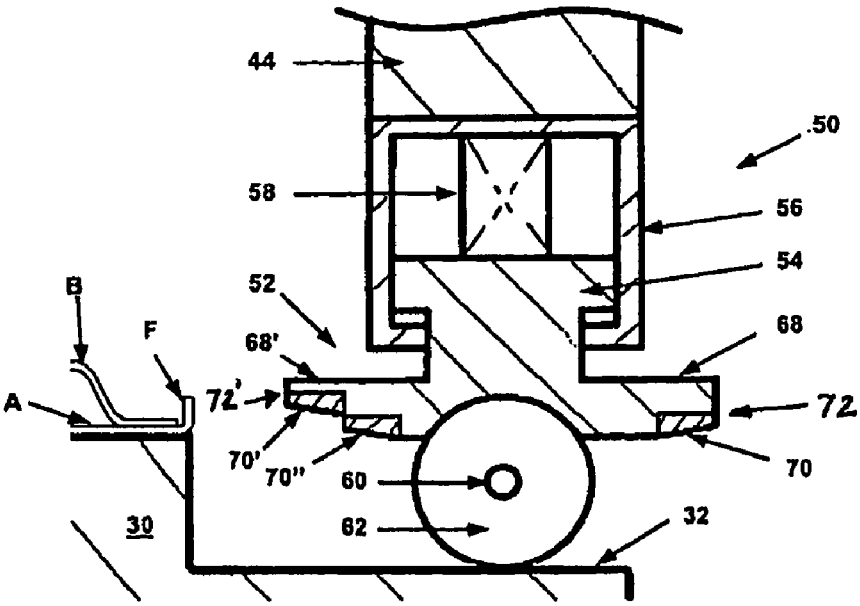
FIG. 4 is a sectional view of the PPFS assembly of the present invention similar to that of FIG. 2 illustrating a second tiered forming steel in its pounce position.
Figure 5:
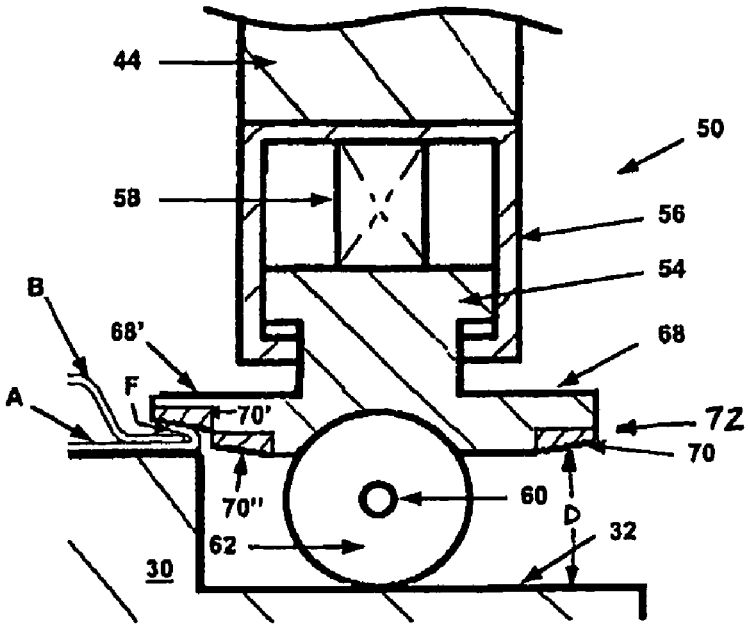
FIG. 5 is a sectional view of the PPFS assembly of the present invention similar to that of FIG. 4 but illustrating the second tiered forming steel in its engaged position.

Cross-sectional views of the PPFS assembly 50 are shown in FIGS. 2 and 3. With respect to these figures, the PPFS assembly 50 includes a reciprocating hub 52 having a piston end 54 mounted in a cylinder 56. The cylinder 56 is fitted rigid to the faceplate 44 (shown in FIG. 1) of the robotic arm 42 as is known in the art. The piston end 54 is captured within the cylinder 56 such that the hub 52 slides or reciprocates along an axis relative to the cylinder 56. Hub 52 has extensions 68, 68' extending outwardly therefrom on the end opposite piston end 54. Forming steels 70, 70', 70" are secured to the extensions 68, 68'.

The number and configuration of the extensions 68, 68' and the forming steels 70, 70', 70" will be dictated by the particular forming and joining operation as mentioned above. For example, and as presently illustrated, the hub 52 includes a first extension 68 extending to the left (as seen in FIGS. 2 and 3) which has a first forming steel 70 disposed on the lower surface 72 thereof. The hub 52 also has a second extension 68' extending to the right (also as seen in FIGS. 2 and 3). The lower surface 72' of the second extension 68' is stepped or tiered such that a second forming steel 70' is disposed at an outer portion of extension 68' and a third forming steel 70" is disposed at an inner portion of extension 68'. Although generally shown to have a tapered or wedged face shape, each forming steels 70, 70', 70" is adapted with a shape formed into its face that closely resembles the preformed shape of the short flange to be formed. Thus, one skilled in the art will recognize that the details of the face shape for each of the forming steel 70, 70', 70" will depend on the geometry of the short flange F to be formed and that the present invention affords the ability to perform multiple short flange forming operations with a single PPFS assembly.

A biasing element or spring 58 is interposed between the cylinder 56 and the piston end 54 to bias the hub 52 away from the cylinder 56. As an alternative to the use of the illustrated spring biasing element 58, a gas-charged cylinder may be placed in the position of the spring 58 to provide the needed biasing. In this manner, the PPFS assembly 50 provides a positional pressure forming tool whereby the position of the robot arm faceplate 44 relative to the lower nest 30 dictates the applied pressure at the interface between the short flange F and the forming steel 70, 70', 70".

The characteristics of the biasing element are such that the pressure applied at the forming steel 70, 70', 70" is linearly proportional to the position of the piston end 54 relative to the cylinder 56 and the faceplate 44. Each unit of linear distance the piston end 54 moves into cylinder 56 will increase the bias of element 58 in a linear proportion. In the event that a gas-filled cylinder is used in lieu of the spring 58, a charge is built up therein and the piston end 54 moves into cylinder 56. This linear relationship is the basis for the positional pressure variance programming that the robotic arm plays.

A roller 62 is rotatably supported from the hub 52 by an axle 60 fixedly mounted in the hub 52 in a direction generally perpendicular to the extensions 68, 68'. The roller 62 operates in conjunction with the robotic arm 42 and a set of guide surfaces 32 formed on the lower nest 30 to provide positional pressure variance of the forming steel 70. When no pressure is applied to the roller 62, the biasing element 58 urges the piston end 54 in its outwardly extended position. Conversely, when pressure is selectively applied to the roller 62 by means of the robotic arm 42 positioning the roller 62 into engagement with the guide surface 32, the piston end 54 is urged into the cylinder 56 causing the biasing element 58 to resist the inward movement of the piston end 54 and generate a counteracting force. In this manner the force applied at the face shape on the forming steel 70 can be precisely controlled when requiring force feedback from the end of the robotic arm 42. The robotic arm 42 can be manipulated to rotate the PPFS assembly 50 through 1800 such that extension 68' is directed toward the short flange F, thereby enabling formation with forming steels 70', 70".

Figure 6:
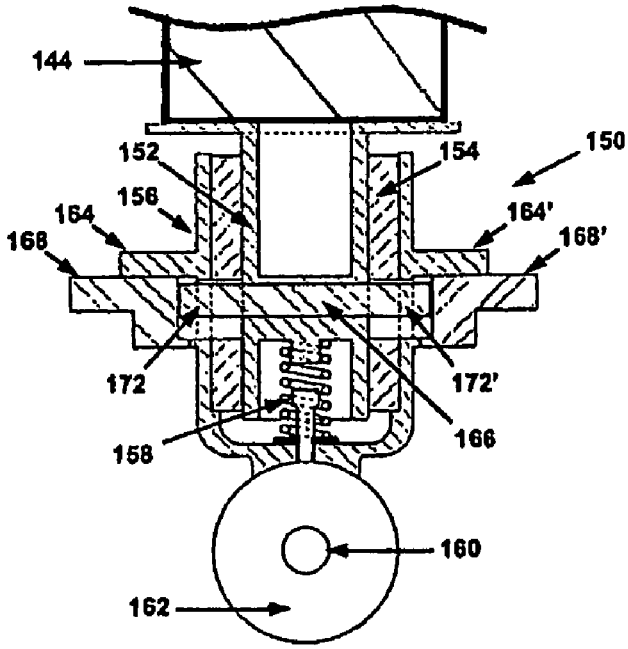
FIG. 6 is a sectional view similar to that of FIG. 2 but illustrating an alternate embodiment of the PPFS assembly in accordance with the present invention.

With reference now to FIG. 6, an alternate embodiment of a positional pressure forming steel (PPFS) assembly 150 is illustrated in which the placement of the hub 152 and the cylinder 156 are reversed relative to the robotic arm face plate 144. Specifically, hub 152 extends from faceplate 144. Cylinder 156 is slidably supported on the hub 152 by a bearing sleeve 154 interposed therebetween. A spring 158 is operably coupled between the hub 152 and the cylinder 156 to bias the hub 152 away from the cylinder 156. An axle 160 extends through a lower portion of the cylinder 156. A roller 162 is rotatably supported on the axle 160. A pair of support flanges 164, 164' extend from the sidewall of cylinder 156. The support flanges 164, 164' are adapted to retain forming steels 168, 168' in a manner similar to that described with reference to FIGS. 2-5. The configuration of the embodiment illustrated in FIG. 6 yields a more compact design than that illustrated in FIGS. 2-5, thereby enabling the use of PPFS assembly 150 in forming operations performed in more confined spaces. Rod 166 extends through hub 152 and slots 172, 172' formed in cylinder 156. The rod 166 cooperates with slots 172, 172' to provide a stop or limit on the range of motions of the cylinder 156 relative to the hub 152. It is to be understood that other aspects of the alternate embodiment of PPFS assembly 150 including its utilization in the forming operation are substantially similar to that of PPFS assembly 50.

With continued reference to the figures, the operation of forming a short flange F on the sheet assembly A in the machine cell 10 will now be generally described. The sheet material A is approximated onto the lower nest 30 and precision positioned by means of the crowders 34. The first sheet material A and the second sheet material B are then securely held in place either by known means or by a vacuum system and upper gate such as disclosed in PCT/US04/34238. With the sheet material so fixed, a short flange forming operation is initiated to form a portion of the first sheet material A by means of a positional pressure forming steel (PPFS) assembly 50.

Initially, the robotic arm 42 orients the forming steel 70 to a pounce position which is normal to and within a close proximity of its associated flange F of interest. In other words, the forming steel 70 is adjacent to (but not in contact with) the upright flange F (as seen in FIG. 2) on sheet A. When a pounce position is initiated, the main roller 62 may contact the guide surface 32. As previously mentioned, the guide surface 32 or landing strip is a flat platform extending from the lower nest 30 that follows the approach path of the forming steel 70. The guide surface 32 is positioned a distance below the forming steel 70 equal to the distance D between the forming steel 70 and the bottom of the roller 62. The robotic arm 42 also preloads the biasing element 58 of the PPFS assembly 50 at this time to remove backlash from its system with enough static energy to prevent deflection of the forming steel 70 when it makes contact with the short flange F.

Next, the robotic arm 42 rapidly manipulates the PPFS assembly 50 along a tool path which is substantially normal to the axis of the axle 60. At this point the roller 62 rolls along the guide surface 32 and the forming steel 70 engages and crash forms the short flange F on sheet A. At this point, the flange F may be fully formed such that the PPFS assembly 50 can be moved to another location on the sheet A.

However, the flange F may only be preformed (i.e. partially bent over) in which case, the roller 62 can be manipulated onto the flange F to finish the forming operation in an expedient manner such as disclosed in PCT Application No. PCT/US2004/038993 entitled "Roller Tool and Positional Pressure Method of Use for the Forming and Joining of Sheet Material" filed on Nov. 19, 2004 by the applicant of the present invention, the disclosure of which is hereby incorporated by reference.

Alternatively, the additional forming steels 70', 70" may be used to perform the final forming operation. In this case the PPFS assembly 50 is rotated 180° to orient the forming steels 70', 70" to a pounce position which is normal to and within close proximity of the preformed flange. The robotic arm 42 rapidly manipulates the PPFS assembly 50 along a tool path to execute the final forming operation in a manner similar to the preforming operation.

The robotic arm 42 manipulates the PPFS assembly away from the machine cell 10. The upper gate 20 is moved away from the sheet materials A and B and the formed sheet material may be unloaded from the lower nest 30.

Those skilled in the art can now appreciate from the foregoing description that the broad teachings of the present invention can be implemented in a variety of forms. Therefore, while this invention has been described in connection with the particular examples thereof, the true scope of the invention should not be so limited since other modifications will become apparent to the skilled practitioner upon a study of the drawings, specification and following claims.

What is claimed is:

1. An apparatus for short flange forming, the apparatus comprising:
   - a nest for holding a first sheet material, the nest having a material contacting surface for supporting a perimeter of the first sheet material;
   - a robotic arm operatively associated with said nest; and
   - a forming steel assembly attached at an end of the robotic arm and a tool steel fixedly attached to the forming steel assembly in a stationary position, the tool steel having a wedge-shaped face generally conforming to a short flange which is positionable by the robotic arm along a tool path in a direction generally parallel to the material contacting portion such that the tool steel is moved in spaced relation to the material contacting portion for crash forming the short flange on the first sheet material.

2. The apparatus of claim 1 wherein said forming steel assembly comprises an extension extending outwardly therefrom and the tool steel is disposed on an end of said extension.

3. The apparatus of claim 2 wherein said robotic arm rotatably supports said forming steel assembly.

4. The apparatus of claim 3 wherein said forming steel assembly further comprises a second extension extending outwardly therefrom and a second tool steel disposed on an end of said second extension.

5. The apparatus of claim 2 wherein said extension comprises a tiered extension having a first tool steel disposed on an outer portion of said extension and a second tool steel disposed on an inner portion of said extension.

6. The apparatus of claim 1 wherein said robotic arm rotatably supports said forming steel assembly.

7. The apparatus of claim 1 wherein said tool steel has a tapered, wedge-shaped face formed thereon.

8. The apparatus of claim 1 further comprising a mechanical positioner coupled to the forming steel assembly for stabilizing the tool steel during crash forming impact.

9. The apparatus of claim 8 wherein the mechanical positioner includes a positional pressure unit operatively associated with the robotic arm and cooperative with the nest for stabilizing the tool steel during crash forming impact.

10. The apparatus of claim 1 further comprising
   - a computer having a tool-driving program operatively associated with the forming and joining assembly for manipulating and guiding the tool steel along the tool path during crash forming impact.

11. The apparatus of claim 10 wherein said forming and joining assembly comprises an extension extending outwardly therefrom and the tool steel disposed on an end of said extension.

12. The apparatus of claim 11 wherein said robotic arm rotatably supports said forming and joining assembly.

13. The apparatus of claim 12 wherein said forming and joining assembly further comprises a second extension extending outwardly therefrom and a second tool steel disposed on an end of said second extension.

14. The apparatus of claim 11 wherein said extension comprises a tiered extension having a first tool steel disposed on an outer portion of said extension and a second tool steel disposed on an inner portion of said extension.

15. The apparatus of claim 10 wherein said robotic arm rotatably supports said forming and joining assembly.

16. The apparatus of claim 10 wherein said tool steel has a tapered, wedge-shaped face formed thereon.

17. The apparatus of claim 10 further comprising a mechanical positioner coupled to the forming steel assembly for stabilizing the tool steel during crash forming impact.

18. The apparatus of claim 17 wherein the mechanical positioner includes a positional pressure unit operatively associated with the robotic arm and cooperative with the nest for stabilizing the tool steel during crash forming impact.

19. An apparatus for forming and joining a first sheet material to a second sheet material, the first sheet material having a periphery, the periphery having a contour, the apparatus comprising:

a nest including a material-contacting portion for holding the first sheet material;

a forming and joining assembly operatively associated with said nest, said assembly including a robotic arm and a tool steel fixedly attached at an end of the robotic arm, the tool steel having a wedge-shaped face generally conforming to a short flange for crash forming the short flange and bending the short flange onto said second sheet material between the tool steel and the material contacting portion;

a mechanical positioner coupled to the forming steel assembly for stabilizing the tool steel during crash forming impact, wherein the mechanical positioner includes a positional pressure unit operatively associated with the robotic arm and cooperative with the nest; and a computer having a tool-driving program operatively associated with the forming and joining assembly for manipulating and guiding the tool steel along an approach path.

20. The apparatus of claim 19 wherein the positional pressure unit further comprises a cylinder and a hub supported within said cylinder for relative sliding movement.

21. The apparatus of claim 20 further including a biasing element interposed between said cylinder and said hub.

22. The apparatus of claim 21 wherein said biasing element is a spring.

23. The apparatus of claim 19 wherein the mechanical positioner includes a roller supported on the positional pressure unit and a guide surface extending from the nest parallel with the approach path.

24. The apparatus of claim 23 wherein said forming and joining assembly further comprises an extension extending outwardly from said positional pressure unit in a direction perpendicular to an axis of rotation of said roller and supporting said tool steel on an end of said extension.

25. An apparatus for short flange forming, the apparatus comprising:

a nest for holding a first sheet material;

a robotic arm operatively associated with said nest;

a forming steel assembly including a tool steel fixedly attached at an end of the robotic arm, the tool steel having a wedge-shaped face generally conforming to a short flange for crash forming the short flange on the first sheet material;

a mechanical positioner coupled to the forming steel assembly for stabilizing the tool steel during crash forming impact, the mechanical positioner including a positional pressure unit operatively associated with the robotic arm and cooperative with the nest.

26. The apparatus of claim 25 wherein the positional pressure unit further comprises a cylinder and a hub supported within said cylinder for relative sliding movement.

27. The apparatus of claim 26 further including a biasing element interposed between said cylinder and said hub.

28. The apparatus of claim 27 wherein said biasing element is a spring.

29. The apparatus of claim 25 wherein the mechanical positioner includes a roller supported on the positional pressure unit and a guide surface extending from the nest parallel with an approach path of the forming steel assembly.

30. The apparatus of claim 29 wherein said forming steel assembly further comprises:

an extension extending outwardly from said positional pressure unit in a direction perpendicular to an axis of rotation of said roller, wherein the tool steel is disposed on an end of said extension.

* * * * *